United States Patent [19]

D'Elia

[11] 4,415,617

[45] Nov. 15, 1983

[54] BASE FABRIC FOR THE MANUFACTURE OF EMBROIDERY AND LACE AND METHOD OF ITS PREPARATION

[75] Inventor: Conrad A. D'Elia, New Milford, Conn.

[73] Assignee: Trustee for David Roth, New York, N.Y.

[21] Appl. No.: 444,513

[22] Filed: Nov. 26, 1982

[51] Int. Cl.[3] ..... B32B 3/24; B32B 5/28; D04H 1/54; D04H 11/00

[52] U.S. Cl. ..... 428/86; 156/253; 156/308.4; 156/309.6; 264/119; 264/324; 428/90; 428/91; 428/95; 428/97; 428/913

[58] Field of Search ..... 428/288, 296, 86, 90, 428/91, 95, 97, 913; 28/117, 122; 264/119, 324; 156/308.4, 309.6, 253

[56] References Cited

U.S. PATENT DOCUMENTS

| | | | |
|---|---|---|---|
| 2,365,315 | 8/1942 | Olsen . | |
| 3,523,861 | 8/1970 | Newman et al. | 156/308.4 |
| 3,684,601 | 8/1972 | Hayward | 156/309.6 |
| 3,697,347 | 10/1972 | Lehmann | 156/309.6 |

*Primary Examiner*—James C. Cannon

*Attorney, Agent, or Firm*—Kane, Dalsimer, Kane, Sullivan & Kurucz

[57] ABSTRACT

An improved base fabric useful for the manufacture of embroidered lace is disclosed. The base fabric is made from a non-woven, needled fabric composed of water-soluble staple fibers which is processed under special conditions to provide one surface of a film made up of thermoplasticized and fused fiber portions.

5 Claims, 2 Drawing Figures

BASE FABRIC FOR THE MANUFACTURE OF EMBROIDERY AND LACE AND METHOD OF ITS PREPARATION

BACKGROUND OF THE INVENTION

1. Field of the Invention

The invention relates to non-woven or formed textile fabrics and more particularly relates to a formed fabric which is useful as a base cloth in the manufacture of embroidery or lace by a process which includes chemical dissolution of the base cloth following the mounting of an embroidery thereon.

2. Brief Description of the Prior Art

The manufacture of lace by use of a base cloth upon which the lace is embroidered, stitched or formed is well-known. The base cloth generally comprises a fabric which is chemically removable from the embroidery by dissolution in a solvent. Representative of base cloths which have been used in the prior art are woven silk fabrics, polyvinyl alcohol films (see U.S. Pat. No. 2,365,315) and woven rayons; see U.S. Pat. No. 3,315,329.

I have now discovered a non-woven or formed fabric, the use of which as a base cloth for the manufacture of lace by the prior art general method, constitutes an improvement. The improvement resides in the ability to obtain greater definition in the lace embroidery, with closer, tighter stitching than could be achieved with the use of prior art face cloths.

SUMMARY OF THE INVENTION

The invention comprises a formed fabric, which comprises;

a planar web having an upper surface and a lower surface and a body between said surfaces, made up of a plurality of water-soluble, thermoplastic, synthetic polymeric resin, staple fibers;

said fibers being homogeneously distributed throughout said web and interlocked together:

said web lower surface being made up of exposed, individual fibers and fiber ends, said upper surface being made up of a gas permeable film, integral with underlying fibers and comprising thermoplasticized and rehardened, flattened fibers and portions of fibers.

The fabric of the invention is useful as a base cloth for the manufacture of embroidery or lace by chemical processes. The invention also comprises the method of making and using the fabric of the invention.

BRIEF DESCRIPTION OF THE DRAWINGS

The accompanying drawing of FIG. 1 is an enlarged view of the side and upper surface of an embodiment fabric of the invention.

DETAILED DESCRIPTION OF THE PREFERRED EMBODIMENTS OF THE INVENTION

Figure 1:
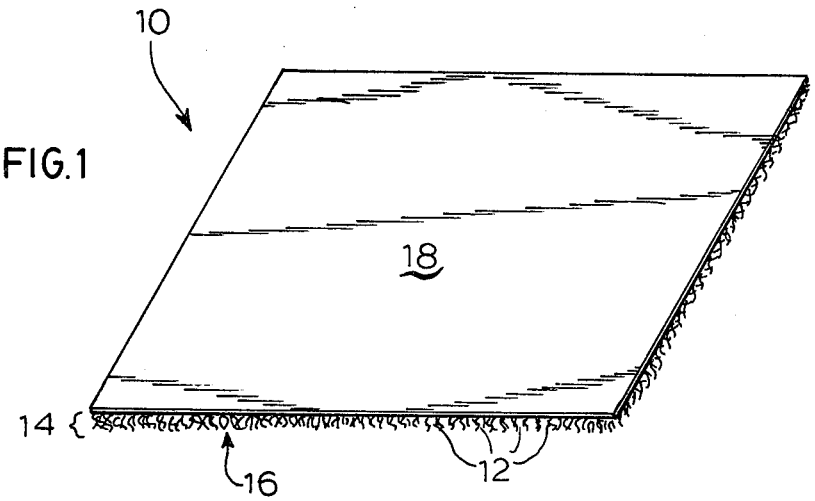
Figure 2:
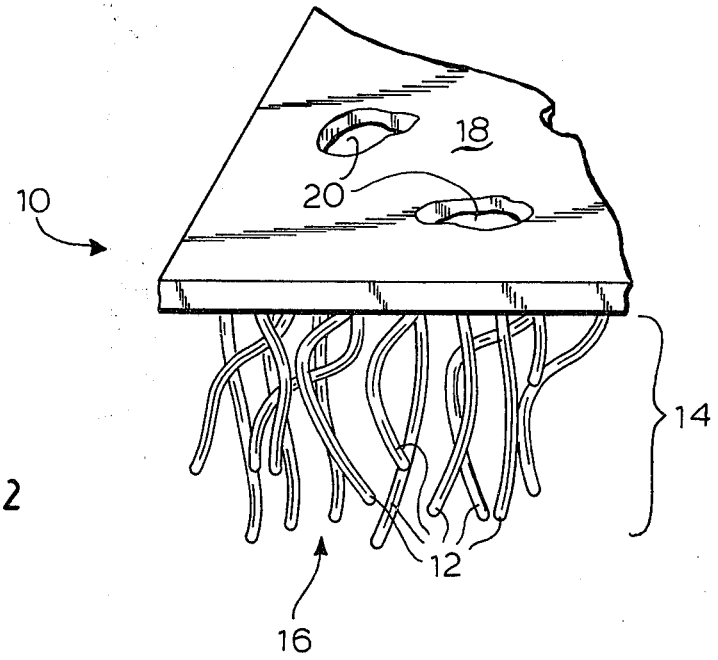
FIG. 2 is a cross-sectional side elevation of a portion of the upper surface shown in FIG. 1, greatly enlarged to show detail.

Those skilled in the art will gain an appreciation of the invention from the following description of preferred embodiments of the invention, when read in conjunction with a viewing of the accompanying drawings of FIGS. 1 and 2.

The drawing of FIG. 1 is a view, greatly enlarged, of the side and upper surface of a preferred embodiment fabric of the invention. The fabric 10 is a planar web made up of a plurality of water-soluble, thermoplastic, synthetic polymeric resin, staple fibers 12. Representative of the fibers 12 are staple fibers of water-soluble poly(ethyleneoxide). Preferred fibers are fibers of polyvinyl alcohol. Advantageously, the fibers 12 will have a denier of from 1 to 50, preferably less than about 10 and most preferably about 2 to 5.

As shown in the drawing of FIG. 1, the staple fibers 12 are homogeneously distributed throughout a web 14. They may have a random or oriented distribution within the web 14. The density of the fibers 12 is advantageously selected to provide a web 14 weight of from about 2 to 3 ounces per square yard. The web 14 is formed of the interlaced or mechanically interlocked fibers 12, by known techniques. For example, the web 14 may be formed by first assembling the fibers 12 on garnett type machinery, by carding or by use of air laying or cross laying techniques. Following the assembly of the fibers 12 in a loose web form, the web may be needled lightly on a needle loom, sufficiently to consolidate the web 14 to facilitate its handling. Techniques of needling to consolidate fibrous webs is well-known and details need not be recited herein; see for example the descriptions of needling given in the U.S. Pat. Nos. 2,059,132; 2,910,763; and 3,684,284. Needling, as carried out in the preparation of the web 14 orients some of the fibers 12 in a direction perpendicular to the planar surfaces of the web 14. Advantageously, the needles selected will be of the type that upon retraction from the web 14 do not engage or dispose fibers 12 from their normal position, which is generally horizontal to the planar surfaces of the formed fabric 10. This is given by way of example only and other web forming techniques may be utilized, such as for example point bonding, thermal bonding and stitch bonding techniques.

As shown in FIG. 1, the lower surface 16 (back side of the fabric 10) presents a "fuzzy" texture, comprised of the loose ends of the fibers 12. This "fuzzy" or nap-like surface 16 is advantageous to the use of the fabric 10 as a base cloth for manufacture of lace. The upper surface 18 of fabric 10, on the other hand, is shown to be a gas permeable film, integral with underlying fibers 12 or portions thereof. The film or surface 18 is in fact formed by thermoplasticizing, flattening and then rehardening fibers 12 or portions thereof at the upper peripheral surface 18 of the web 14, while leaving the underlying fibers 12 unchanged. The thickness of the film comprising surface 18 is advantageously within the range of from 3 to 5 mils. Such a film structure is important to the use of the fabric 10 as a base cloth for the manufacture of lace. The film-like surface 18 is formed in the method of the invention by calendering the web 14 under heat, steam and pressure conditions such that the film surface 18 is formed through a plasticizing and flattening of the exposed portions of the fibers 12, in the peripheral surface of the web 14. The film surface 18 is of such a character that it permits the passage of vapor, i.e.; gas permeable through small openings 20. The resulting surface 18 of fabric 10 has a smooth film-like or paper-like appearance and texture. However, close examination of the surface 18 indicates the film-like surface is actually discontinuous due to a plurality of openings 20, as shown in FIG. 2, a cross-sectional view of a portion of the surface 18 greatly enlarged. Without being bound by any theory, it is believed that this unique surface 18 structure as illustrated in FIG. 2 and described above, accounts for the advantageous properties in the fabrics 10 finished by the method of the invention. As also shown in FIG. 2, the surface exposed portions of thermoplastic fibers 12 are flattened without changing significantly the configuration of underlying fiber 12 portions. The fabric 10 will accept closely spaced embroidery needle stitching without significant tearing of the fabric 10 and will firmly hold the embroidery piece until dissolved away in solvent. This is due in part to the homogeneous nature or structure obtained by the fiber 12 positions within the fabric 10. Also, the thermoplasticizing or fusion of portions of the fibers 12 in the fabric adds strength to the overall fabric 10.

Calendering of the needled fabric may be carried out employing conventional calendering apparatus adapted to press the non-woven and needled fabric between opposing rollers, one of which is heated to effect the plasticizing of the thermoplastic fibers 12 where they are exposed in the peripheral upper surface. The lower roller is preferably at a temperature which will not affect thermoplasticizing of the fibers 12 exposed on the lower surface of the web 14. The gap of the opposed rollers may be adjusted to press the non-woven, needled fabric to a thickness of from about 8 to 15 mils under heat and pressure. Generally, little overall compression of the web 14 results from the calendering process, the chief aim being to form the film surface 18.

Those skilled in the art will appreciate that optimum temperatures applied on the fabric sheet to form the film surface 18 during passage between the rollers will depend on the nature of the thermoplastic fibers involved. In general, temperatures will be within the range of from about 100 to about 180 degrees centigrade. Optimum speeds for the sheet through the nip of the rollers, the gap, if any, at the nip of these rollers and the temperatures employed may be selected by trial and error techniques. As an example, when the sheet or web 14 is a non-woven fabric of 100% polyvinyl alcohol fibers 12, a speed of from about 1 to about 8 yards per minute, adjusted according to the size of the calender used, under a constant minimum pressure of about 1500 psi and at a temperature of from about 100 to about 180 degrees centigrade will be advantageous but will vary according to the equipment used. It will be appreciated that the gap range between the opposing rollers selected, will be less than the original thickness of the non-woven fabric.

Critical to obtaining the product of the invention is the maintenance of steam in the fabric of web 14 while it is being pressed between the rollers. This may be carried out by introducing steam into the fabric immediately before it enters the nip of the calender rollers. Sufficient steam should be present to provide a humidity of from about 40 to about 80% (relative) in the zone of the fabric as it is pressed and partially heated. This range of humidity and the presence of steam functions to aid in the plasticizing of fibers 12 and formation of the film surface 18. Steam aids in the formation of a proper portion of holes 20 in the film surface 18. Apparatus and methods for steaming textile fabrics is well-known in the art.

The following example describes the manner and process of making and using the invention and sets forth the best mode contemplated by the inventor but is not to be construed as limiting. Where indicated, physical test data was obtained by the following test methods.

| PROPERTY | TEST METHOD |
|---|---|
| Weight (oz/yd. sq.) | ASTM: D-1910-64 |
| Fabric Thickness (mils) | ASTM: D-1777-62 |
| Thickness of film surface (mils) | ASTM: D-1777-62 |
| Mullenburst (psi) | ASTM: D-1117-61 |
| Tensile, grab (lbs.; machine direction × cross machine direction) | ASTM: D-1117-69 |
| Elongation at break (percent; machine direction × cross machine direction) | ASTM: D-1117-69 |

EXAMPLE 1

A non-woven web of polyvinyl alcohol fibers, having a length of about 2.1 inches and a denier of 3.2 is provided. The non-woven web of fibers is lightly needled to consolidate the web sufficiently so that it may be handled. The provided web has a weight of about 2.5 ozs/yd. sq. and a thickness of about 10 mils. The web is passed through the nip of opposed rollers, the lower of which is maintained at ambient (26° C.) temperatures while the upper platen is maintained at a temperature of about 160 degrees centigrade. The gap of the opposing rollers is about 0 mils. Immediately prior to its entry into the nip of the opposed rollers, steam is injected into the non-woven fabric to effect a relative humidity therein of about 60 percent. The fabric is passed through the nip of the opposed rollers at a speed of about 8 yards per minute. The calendered fabric may be characterized in that it has a film-like upper surface with a thickness of about 4 mils, and which is gas permeable.

Representative fabrics made as described in the above example may be characterized as having a Mullenburst of from 60 to 85 psi, a tensile grab of 8.0×8.0 lbs. (machine direction x cross-machine direction) and an elongation at break of 10×5 percent (machine direction x cross-machine direction).

The fabric prepared in accordance with the above example may be used as a base cloth for the chemical manufacture of embroidery or lace, and exhibits a high degree of tenacity for holding embroidery stitched thereon, even when the stitching needles are very closely spaced. The base cloth will dissolve away from embroidery stitched thereon, when exposed to water at a temperature of about 100° C.

What is claimed is:

1. A formed fabric, which comprises;

a web having an upper and a lower surface and a body therebetween having a plurality of water-soluble, thermoplastic, synthetic polymeric resin staple fibers;

said fibers being homogeneously distributed throughout said web and interlocked together;

said lower surface having a plurality of exposed individual fibers and fiber ends and said upper surface comprising a gas permeable film, integral with underlying fibers and comprising thermoplasticized and rehardened, flattened fibers and portions of fibers.

2. The fabric of claim 1 wherein interlocking of the fibers is mechanical, of the character achieved with needled staple fibers.

3. The fabric of claim 1 having a weight within the range of from about 2.0 to 3.0 oz/sq. yd. and a thickness of from about 8 to about 15 mils; a Mullenburst of 60 to 85 psi; a tensile, grab of about 8.0×8.0 lbs. (machine direction x cross-machine direction) and an elongation at break of 10×5 percent (machine direction x cross-machine direction); said film having a thickness within the range of from about 3 to 5 mils.

4. The fabric of claim 1 wherein said resin is a polyvinyl alcohol.

5. A method of manufacturing an improved formed fabric, useful as a base cloth for the making of lace, which comprises;

providing a planar web having upper and lower surfaces and a body made up of a plurality of water-soluble, thermoplastic, synthetic polymeric resin staple fibers, said fibers being homogeneously distributed throughout the web and mechanically interlocked together, said interlocking being of the character achieved with needled staple fibers;

said web having a weight of from 2.0 to 3.0 oz/sq. yd;

calendering the web under sufficient heat, pressure and humidity to thermoplasticize the fibers on the upper surface only of said web, whereby there is obtained a discontinuous, gas permeable film having a thickness of from about 3 to about 5 mils.

* * * * *